US011730245B2

(12) United States Patent
Ni

(10) Patent No.: US 11,730,245 B2
(45) Date of Patent: Aug. 22, 2023

(54) HAIR DRYER WITH HIGH HEAT DISSIPATION EFFICIENCY

(71) Applicant: KINGCLEAN ELECTRIC CO., LTD., Jiangsu (CN)

(72) Inventor: Zugen Ni, Jiangsu (CN)

(73) Assignee: KINGCLEAN ELECTRIC CO., LTD.

( * ) Notice: Subject to any disclaimer, the term of this patent is extended or adjusted under 35 U.S.C. 154(b) by 161 days.

(21) Appl. No.: 17/266,941

(22) PCT Filed: Dec. 19, 2019

(86) PCT No.: PCT/CN2019/126728
§ 371 (c)(1),
(2) Date: Feb. 8, 2021

(87) PCT Pub. No.: WO2020/186854
PCT Pub. Date: Sep. 24, 2020

(65) Prior Publication Data

US 2021/0298443 A1 Sep. 30, 2021

(30) Foreign Application Priority Data

Mar. 15, 2019 (CN) ..... 201910199571.5

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12
USPC ..... 34/95–100
See application file for complete search history.

(56) References Cited

U.S. PATENT DOCUMENTS 1,746,973 A * 2/1930 Troccoli ..... A45D 20/46 34/99
3,220,119 A * 11/1965 Jepson ..... A45D 20/18 34/283
4,972,065 A * 11/1990 Ohlsen ..... A45D 20/12 34/97

(Continued)

FOREIGN PATENT DOCUMENTS

CN 201741682 U 2/2011
CN 106015050 A 10/2016

(Continued)

OTHER PUBLICATIONS

International Search Report and Written Opinion, International Application No. PCT/CN2019/126728, dated Sep. 24, 2020, 8 pages, with English Translation.

(Continued)

*Primary Examiner* — Stephen M Gravini
(74) *Attorney, Agent, or Firm* — Quarles & Brady LLP

(57) ABSTRACT

Disclosed is a hair drier with a high heat dissipation efficiency. The hair drier comprises a machine body, and a heating device arranged in the machine body, wherein the machine body is internally provided with an air channel. The hair drier further comprises a heat dissipation device made of a heat-conducting material, wherein the heating device is located outside the air channel, and the heat dissipation device is in heat-conducting connection with the heating device and is at least partially arranged in the air channel.

10 Claims, 4 Drawing Sheets

(56) References Cited

U.S. PATENT DOCUMENTS

| | | | | | |
|---|---|---|---|---|---|
| 5,613,305 | A * | 3/1997 | Narrin | A45D 20/12 34/91 |
| 5,832,624 | A * | 11/1998 | Narrin | F16M 13/00 34/97 |
| 9,526,311 | B1 * | 12/2016 | Schaefer | A45D 20/10 |
| 10,869,529 | B2 * | 12/2020 | Chia | A45D 2/00 |
| 11,076,672 | B2 * | 8/2021 | Wojczak | A45D 20/12 |
| 11,213,174 | B2 * | 1/2022 | Yoo | F04D 19/002 |
| 11,253,039 | B1 * | 2/2022 | Lei | A45D 20/12 |
| 11,259,615 | B2 * | 3/2022 | Liu | F04D 29/668 |
| 11,375,792 | B2 * | 7/2022 | Min | A45D 20/24 |
| 2007/0166208 | A1 | 7/2007 | Tanaka et al. | |
| 2008/0000101 | A1 | 1/2008 | Ishikawa et al. | |
| 2013/0326898 | A1 * | 12/2013 | Quessard | H02K 11/33 34/97 |
| 2019/0357653 | A1 * | 11/2019 | Guerreiro | A45D 20/12 |
| 2020/0275755 | A1 * | 9/2020 | Hsu | A45D 20/12 |
| 2021/0169195 | A1 * | 6/2021 | Jeong | H01M 50/213 |
| 2021/0235947 | A1 | 8/2021 | Ni | |
| 2021/0298443 | A1 * | 9/2021 | Ni | A45D 20/12 |
| 2021/0307476 | A1 * | 10/2021 | Ni | A45D 20/12 |
| 2021/0321738 | A1 * | 10/2021 | Ni | A45D 20/122 |
| 2022/0007809 | A1 * | 1/2022 | Wang | A45D 20/12 |

FOREIGN PATENT DOCUMENTS

| | | | | |
|---|---|---|---|---|
| CN | 106880155 | A | 10/2016 | |
| CN | 205624987 | U | 10/2016 | |
| CN | 205624987 | U | 10/2016 | |
| CN | 207532060 | U | 6/2018 | |
| CN | 108708339 | A | 10/2018 | |
| CN | 108903200 | A | 11/2018 | |
| CN | 109171160 | A | 1/2019 | |
| CN | 109171160 | A | 1/2019 | |
| CN | 109259408 | A | 1/2019 | |
| CN | 109259408 | A | 1/2019 | |
| CN | 208524019 | U | 2/2019 | |
| CN | 109700159 | A | 5/2019 | |
| CN | 109743859 | A * | 5/2019 | A45D 20/12 |
| CN | 109743859 | A | 5/2019 | |
| CN | 109764002 | A | 5/2019 | |
| CN | 209671282 | U | 11/2019 | |
| CN | 209982903 | U | 1/2020 | |
| EP | 2308337 | A1 | 4/2011 | |
| EP | 3831240 | A1 | 6/2021 | |
| JP | 01990034992 | A | 2/1990 | |
| JP | 1990-034992 | B2 | 8/1990 | |
| JP | 1997-224706 | A | 9/1997 | |
| JP | 01997224736 | A | 9/1997 | |
| JP | 2006-020431 | A | 1/2006 | |
| JP | 4046020 | B2 | 2/2008 | |
| JP | 2015-066446 | A | 4/2015 | |
| JP | 2017-104554 | A | 6/2017 | |
| JP | 2018-033965 | A | 3/2018 | |
| KR | 1020050108799 | A | 11/2005 | |
| WO | WO-2014183289 | A1 * | 11/2014 | A45D 20/12 |

OTHER PUBLICATIONS

Extended European Search Report, Application No. 19919742.7, dated Aug. 25, 2021, 7 pages.

International Search Report and Written Opinion, International Application No. PCT/CN2019/126727, dated Feb. 6, 2020, 7 pages with English Translation.

International Search Report and Written Opinion, International Application No. PCT/CN2019/126731, dated Mar. 18, 2020, 7 pages, with English Translation.

Japan Office Action, Japan Application No. 2021-510300 dated Mar. 8, 2022, 6 pages.

Extended European Search Report, European Application No. 19920309.2 dated Mar. 14, 2022, 9 pages.

Japan Office Action, Japan Application No. 2020-565751 dated Feb. 26, 2022, 8 pages.

Extended European Search Report, European Application No. 19920123.7 dated Nov. 21, 2016, 9 pages.

Japan Office Action, Japan Application No. 2021-517045 dated Apr. 5, 2022, 11 pages.

* cited by examiner

HAIR DRYER WITH HIGH HEAT DISSIPATION EFFICIENCY

CROSS REFERENCE TO RELATED APPLICATION

This application is a 371 National Phase of PCT/CN2019/126728 filed Dec. 19, 2019, by Zugen N I entitled, "HAIR DRIER WITH HIGH HEAT DISSIPATION EFFICIENCY," which claims priority to Chinese patent application No. 201910199571.5, entitled "HAIR DRIER WITH HIGH HEAT DISSIPATION EFFICIENCY", and filed on Mar. 15, 2019, the content of which is herein incorporated in its entirety by reference.

TECHNICAL FIELD

The present disclosure relates to the technical field of home appliances, in particular, to a hair dryer with high heat dissipation efficiency.

BACKGROUND

A hair dryer is a home appliance that uses a fan to rotate and blow out air to dry wet objects. A motor is used to drive the fan to rotate.

In order to improve product quality and improve user experience, the brushless motor is increasingly adopted by the motor of the current hair dryer. However, this type of hair dryer also has some disadvantages which are mainly in that: a main control board of the brushless motor generates heat seriously (mainly due to a metal oxide semiconductor (MOS) transistor arranged on the main control board). Moreover, it is not recommended to place the main control board directly in an air passage (placing the main control board in the air passage will cause noise to increase and turbulence to be generated in the inletting air). Thus, heat dissipation capability of the main control board is poor, which in turn renders working performance of the hair dryer unstable.

SUMMARY

The present disclosure provides a hair dryer with high heat dissipation efficiency which includes a body formed with an air passage therein and a heating component disposed in the body. The hair dryer further includes a heat dissipating device made of thermally conductive material. The heating component is located outside the air passage. The heat dissipating device is thermally connected to the heating component and is at least partially disposed in the air passage.

In particular, the hair dryer with high heat dissipation efficiency includes a plurality of groups of the heat dissipating devices. The plurality of groups of the heat dissipating devices are thermally connected to different heating points on the heating component, respectively.

In particular, the heat dissipating device includes a plurality of fins extending from the heating component toward an air inlet end.

In particular, each of the fins includes a top portion in the air passage, a front side surface at a windward side, and a rear side surface at a leeward side. The top portion is a slope. The front side surface is in an externally convex arched shape. A connection portion between the rear side surface and the top portion is an arc surface.

In particular, the heat dissipating device further includes a base. The fins are disposed on the base by bottom portions thereof, respectively.

In particular, the base is in a sector shape, and the sector-shaped base is aligned with heating points on the heating component. Alternatively, the base is in a ring shape, and the ring-shaped base is aligned with the heating component as a whole.

In particular, the base is thermally connected to the heating points on the heating component.

In particular, the base is provided with a stepped surface thereon. The stepped surface is attached to the heating component.

In particular, a gap between the heat dissipating device and the heating component is filled with thermally conductive material.

In particular, the heating component is a metal oxide semiconductor (MOS) transistor and/or a silicon controlled rectifier.

The hair dryer with high heat dissipation efficiency according to the present disclosure is provided with the heat dissipating device made of thermally conductive material therein. The heat dissipating device is thermally connected to the heating component and is at least partially disposed in the air passage. Thus, the heat on the heat dissipating device may be taken away by the airflow whose temperature is lower than the temperature of the heat dissipating device, such as natural wind and the like. Therefore, the effect of heat dissipation for the heating component is achieved, and the problem that the main control board in the current hair dryer cannot dissipate heat well is solved.

DETAILED DESCRIPTION OF THE EMBODIMENTS

The technical solutions of the present disclosure will be further illustrated below in conjunction with the attached drawings and specific embodiments.

Figure 1:
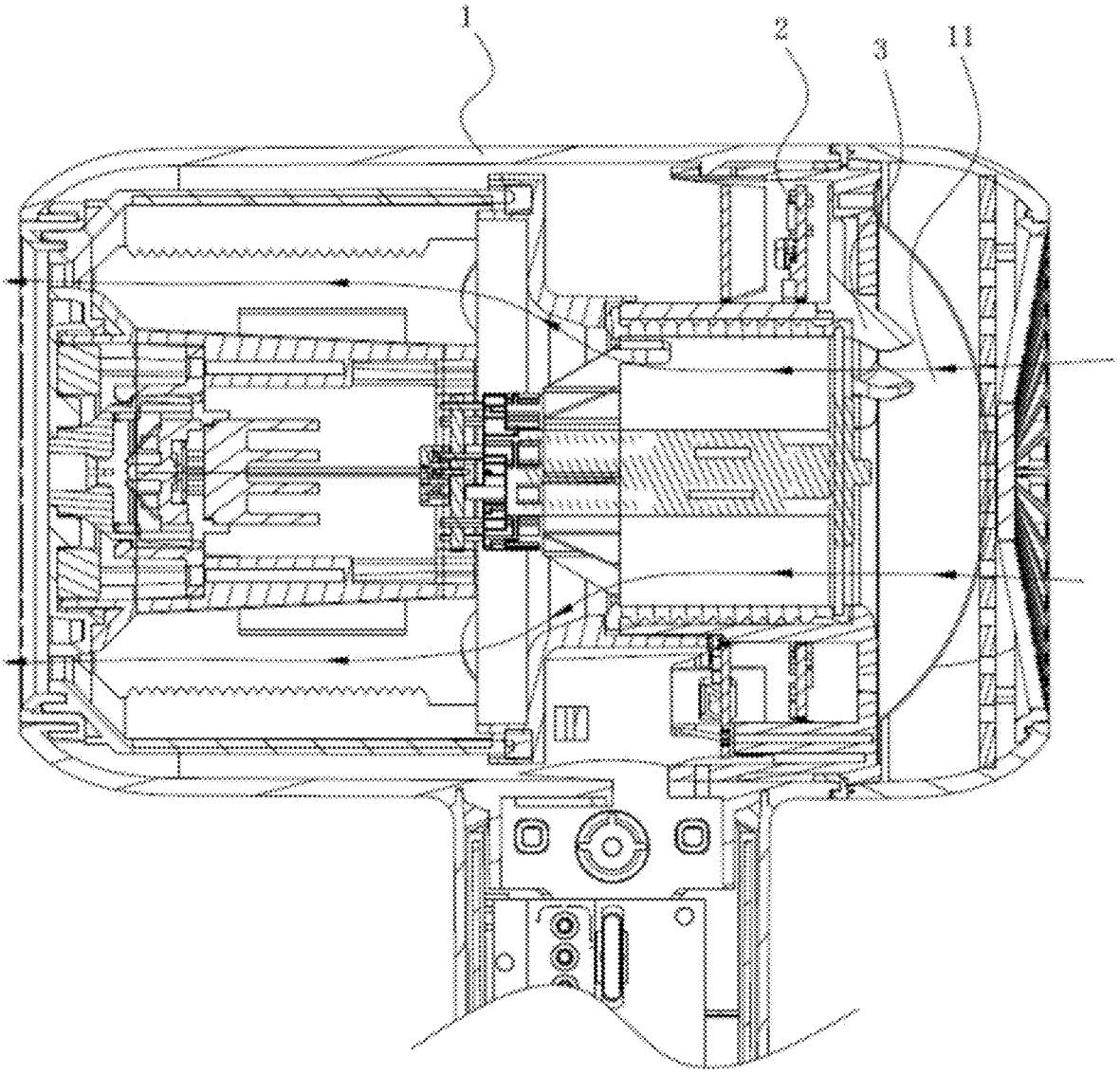
FIG. 1 is a cross-sectional view of a hair dryer with high heat dissipation efficiency according to an embodiment of the present disclosure.
Figure 2:
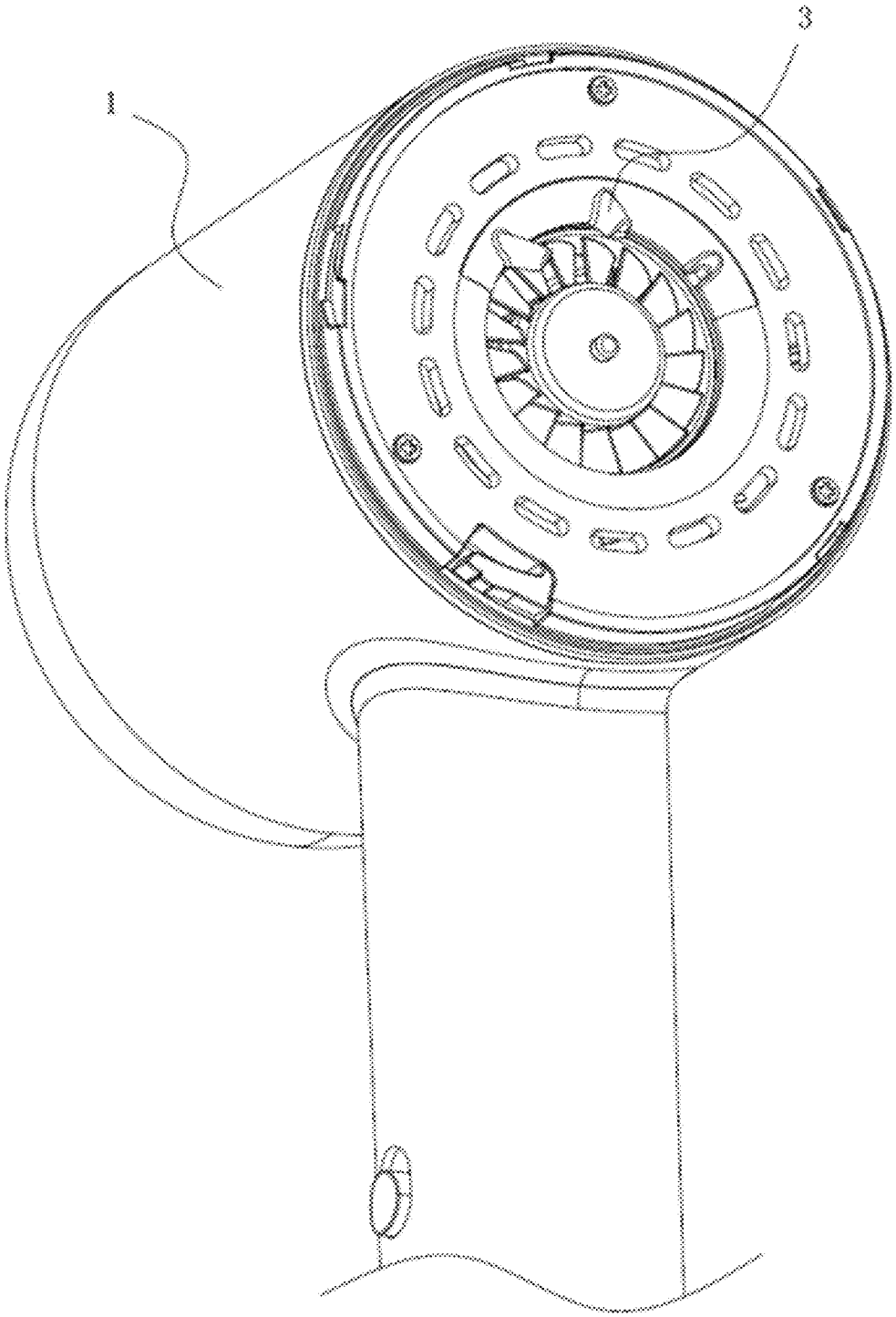
FIG. 2 is a first schematic view of a hair dryer with high heat dissipation efficiency according to an embodiment of the present disclosure.
Figure 3:
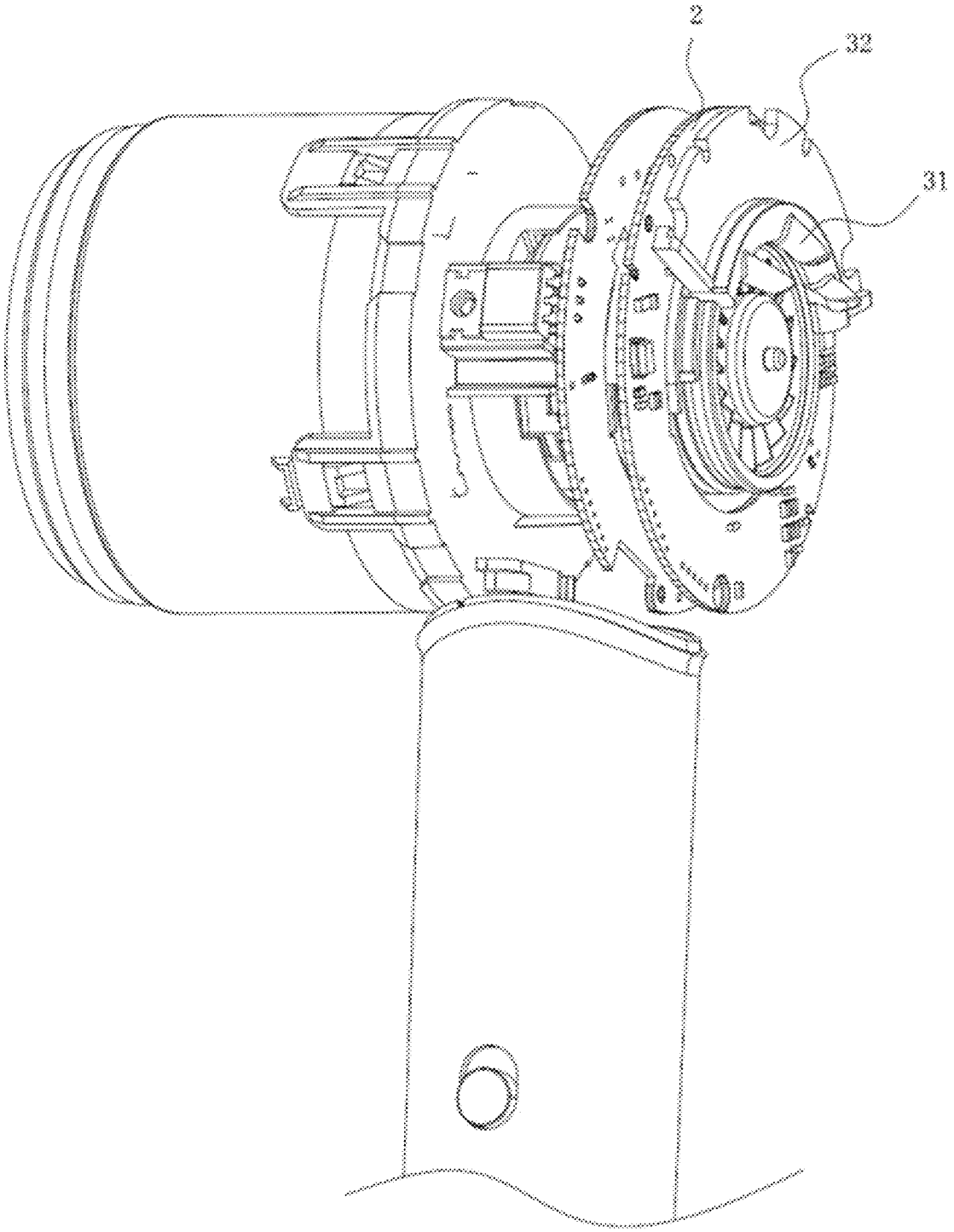
FIG. 3 is a second schematic view of a hair dryer with high heat dissipation efficiency according to an embodiment of the present disclosure.

This embodiment discloses a hair dryer with high heat dissipation efficiency. As shown in FIGS. 1 to 3, the hair dryer includes a body 1, a heating component 2 disposed in the body 1, and a heat dissipating device 3 made of thermally conductive material. The thermally conductive material may be, but is not limited to metal. An air passage 11 is formed in the body 1. The heating component 2 is located outside the air passage 11. The heat dissipating device 3 is thermally connected to the heating component 2 and is at least partially disposed in the air passage 11. The heating component 2 can be, but is not limited to, a main control board provided with heating elements such as metal oxide semiconductor (MOS) transistors and silicon controlled rectifiers, but not a heating wire used for heating airflow in a conventional hair dryer. The so-called "thermally connected" can be that the heat dissipating devices 3 is in direct contact with the heating component 2, or that the heat dissipating devices 3 is in indirect contact with the heating component 2 through other structures, as long as the heat can be conducted via these structures.

The heat dissipating device 3 is thermally connected to the heating component 2, and thus the heat on the heating component 2 can be transferred to the heat dissipating device 3. The heat dissipating device 3 is located in the air passage, and the heat on the heat dissipating device 3 is taken away by the airflow (such as natural wind and the like) whose temperature is lower than the temperature of the heat dissipating device 3, so that the effect of heat dissipation for the heating component 2 is achieved. That is, the heat dissipating device 3 serves as an auxiliary heat dissipating device of the heating component 2, which can conduct away the heat on the heating component 2 in a timely and efficient manner, ensuring that structures such as the main control board and the like can operate normally, and prolonging the service life of the product. The problem that the main control board in the current hair dryer cannot dissipate the heat well is solved.

In order to better dissipate heat, a plurality of groups of the heat dissipating devices 3 can be disposed along a direction of an inletting air. The plurality of groups of the heat dissipating devices 3 are thermally connected to different heating points on the heating component 2, respectively, and are respectively used for dissipating heat for the different heating points, so that the heat dissipation efficiency is higher. The heating points can be, but are not limited to, MOS transistors and silicon controlled rectifiers on the main control board.

Figure 4:
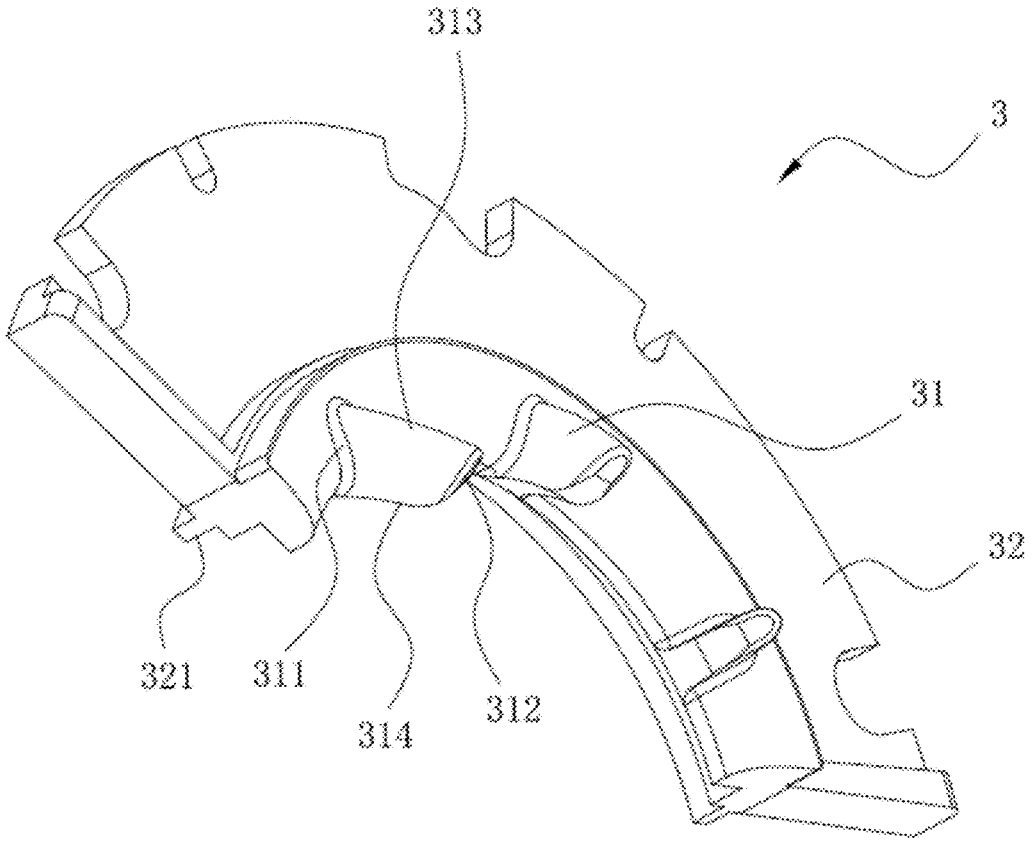
FIG. 4 is a schematic view of a heat dissipating device according to an embodiment of the present disclosure.

The specific structure of the heat dissipating device 3 is not limited. Preferably, as shown in FIG. 4, the heat dissipating device 3 includes a base 32 and a plurality of fins 31 disposed on the base 32. The fins 31 extend from the heating component 2 toward an air inlet end. Preferably, the fins 31 are disposed obliquely toward a direction of an incoming air, so as to reduce the airflow resistance and noise as much as possible while increasing the heat exchange area with the airflow. That is, a direction in which the fins 31 extend is opposite to the direction of the inletting air of the hair dryer, so that the fins 31 can be in contact with the airflow having a lower temperature and being at a more upstream position.

The fin 31 includes a bottom portion 311 away from the air inlet end, a top portion 312 adjacent to the air inlet end, a front side surface 313 at a windward side, and a rear side surface 314 at a leeward side. The fins 31 are disposed on the base 32 by the bottom portion 311 thereof, respectively, so that the structure of the fins 31 is more stable. The top portion 312 is consequentially in the air passage 11, and whether other structures are in the air passage 11 or not is determined according to actual usage requirements.

Along the direction of the inletting air, a distance between the top portion 312 and the bottom portion 311 gradually decreases. That is, the top portion 312 is a slope inclined along the direction of the inletting air, so that the airflow resistance may be reduced without affecting the heat dissipation, and the noise is reduced. The front side surface 313 is in an externally convex arched shape, that is, similar to a corrugated shape, so that the airflow is more smooth and stable when the inletting air blows over the front side surface 313, and the noise is lowered. A connection portion between the rear side surface 314 and the top portion 312 is an arc surface. That is, the rear side surface 314 and the top portion 312 are smoothly and transitionally connected with each other, which prevents the inletting air from being blocked at the connection portion between the rear side surface 314 and the top portion 312.

The base 32 is provided with a stepped surface 321. The stepped surface 321 is attached to the heating component 2, and thus the thermal conduction efficiency is high. In addition, the stepped surface 321 can also play a role of mutual limiting between the base 32 and the heating component 2.

The specific shape of the base 32 is not limited, as long as it can efficiently conduct heat for the heating component 2. Preferably, the base 32 is a sector-shaped structure aligned with the heating point on the heating component 2 or a ring-shaped sheet structure aligned with the heating component 2 as a whole. When the base 32 is ring-shaped, the heat dissipation area is large and the heat dissipation efficiency is high. When the base 32 is sector-shaped, it is small in volume and light in weight, which is beneficial to miniaturization and lightening of the hair dryer. Preferably, the base 32 is directly thermally connected to the heating points on the heating component 2, and thus the thermal conductivity efficiency is higher.

The base 32 not only can conduct heat at a portion attached to the heating component 2, but also can quickly conduct away the heat in a space around the heating component 2 at a portion not attached to the heating component 2, which also has the function of assisting the heating component 2 in heat dissipation.

On the basis of the above structure, a gap between the heat dissipating device 3 and the heating component 2 is filled with thermally conductive material, so that the heat dissipating device 3 and the heating component 2 are reliably thermally connected with each other, thus avoiding that the heat on the heating component 2 cannot be transferred to the heat dissipating device 3 due to the isolation of air. The thermally conductive material can be, but is not limited to, thermally conductive silicone grease, as long as it can ensure an efficient heat transfer.

It is noted that the above contents are only the preferred embodiments of the present disclosure and the technical principles applied. Those skilled in the art will understand that the present disclosure is not limited to the specific embodiments described herein. Various obvious changes, readjustments and substitutions can be made by those skilled in the art, without departing from the protection scope of the present disclosure. Therefore, although the present disclosure has been described in more detail through the above embodiments, the present disclosure is not limited to the above embodiments, and can further include more other equivalent embodiments without departing from the concept of the present disclosure. The scope of the present disclosure shall subject to the scope of the appended claims.

What is claimed is:

1. A hair dryer with high heat dissipation efficiency, comprising:

a body formed with an air passage therein; and a heating component disposed in the body, wherein the hair dryer further comprising a heat dissipating device made of thermally conductive material, the heating component being located outside the air passage and surrounded by at least a portion of the air passage, the heat dissipating device being thermally connected to the heating component and being at least partially disposed in the air passage, and wherein the body includes an air inlet end and an air outlet end, and the air passage is extended between the air inlet end and the air outlet end;

wherein the heat dissipating device comprises a plurality of fins extending from the heating component toward the air inlet end;

wherein each of the fins comprises a top portion adjacent to the air inlet end and in the air passage, a front side surface at a windward side, and a rear side surface at a leeward siding;

wherein the top portion is a slope inclined along the direction of the inletting air, the front side surface is in an externally convex arched shape, and a connection portion between the rear side surface and the top portion is an arc surface.

2. The hair dryer with high heat dissipation efficiency according to claim 1, comprising a plurality of groups of heat dissipating device, the plurality of groups of the heat dissipating device being thermally connected to different heating points on the heating component, respectively.

3. The hair dryer with high heat dissipation efficiency according to claim 1, wherein the heat dissipating device further comprises a base, and the fins are disposed on the base by bottom portions thereof, respectively.

4. The hair dryer with high heat dissipation efficiency according to claim 3, wherein the base is in a sector shape, and the base is aligned with heating points on the heating component.

5. The hair dryer with high heat dissipation efficiency according to claim 4, wherein the base is thermally connected to the heating points on the heating component.

6. The hair dryer with high heat dissipation efficiency according to claim 3, wherein the base is provided with a stepped surface thereon, and the stepped surface is attached to the heating component.

7. The hair dryer with high heat dissipation efficiency according to claim 1, wherein a gap between the heat dissipating device and the heating component is filled with thermally conductive material.

8. The hair dryer with high heat dissipation efficiency according to claim 1, wherein the heating component is a metal oxide semiconductor (MOS) transistor and/or a silicon controlled rectifier.

9. The hair dryer with high heat dissipation efficiency according to claim 3, wherein the base is in a ring shape, and the base is aligned with the heating component as a whole.

10. A hair dryer with high heat dissipation efficiency, comprising:

a body;

an air passage configured within the body;

a heating component positioned in the body and outside the air passage and surrounded by at least a portion of the air passage, the heating component comprising a metal oxide semiconductor (MOS) transistor;

a base thermally coupled to the heating component and positioned outside the thermal passage, the base being configured to assist heat dissipation of the heating component; and a heat dissipating device comprising thermally conductive material, the heat dissipating device comprising a first portion and a second portion, the first portion being positioned outside the air passage and thermally coupled to the heating component, the second portion being positioned inside the air passage;

wherein the air passage is free from turbulence attributed to the heating component;

wherein the heat dissipating device comprises a plurality of fins extending from the heating component toward an air inlet end of the body;

wherein each of the fins comprises a top portion adjacent to the air inlet end and in the air passage, a front side surface at a windward side, and a rear side surface at a leeward siding;

wherein the top portion is a slope inclined along the direction of the inletting air, the front side surface is in an externally convex arched shape, and a connection portion between the rear side surface and the top portion is an arc surface.

* * * * *